United States Patent [19]

Krause et al.

[11] 4,158,581

[45] Jun. 19, 1979

[54] METHOD OF MAKING MAGNETIC COMPONENT FOR DIRECT CURRENT APPARATUS

[75] Inventors: Robert F. Krause, Murrysville; Norman M. Pavlik, Wilkins Township, Allegheny County, both of Pa.

[73] Assignee: Westinghouse Electric Corp., Pittsburgh, Pa.

[21] Appl. No.: 896,534

[22] Filed: Apr. 14, 1978

[51] Int. Cl.[2] ..... H01F 1/08

[52] U.S. Cl. ..... 148/105; 148/121; 148/122; 264/111; 264/DIG. 58

[58] Field of Search ..... 148/104, 105, 121, 122; 428/928; 264/111, DIG. 58

[56] References Cited

U.S. PATENT DOCUMENTS

| | | | |
|---|---|---|---|
| 3,235,675 | 2/1966 | Blume | 310/43 |
| 3,848,331 | 11/1974 | Pavlik et al. | 148/105 |
| 3,948,690 | 4/1976 | Pavlik et al. | 148/105 |

*Primary Examiner*—Arthur J. Steiner
*Attorney, Agent, or Firm*—L. P. Johns

[57] ABSTRACT

A method of making compact cores for use in direct current magnetic apparatus characterized by the steps of severing particles from thin, flat strips of ferrous alloys, said particles being substantially of elongated rectangular shape, annealing said laminations in decarburizing and deoxidizing atmosphere to improve the magnetic characteristics by reducing carbon to less than 0.01% and relieving stresses, compressing the particles into a solidified configuration of the desired core component, and annealing the core component at a temperature upwards of 2200° F. in a non-oxidizing atmosphere to improve the permeability and coercive force values.

5 Claims, 1 Drawing Figure

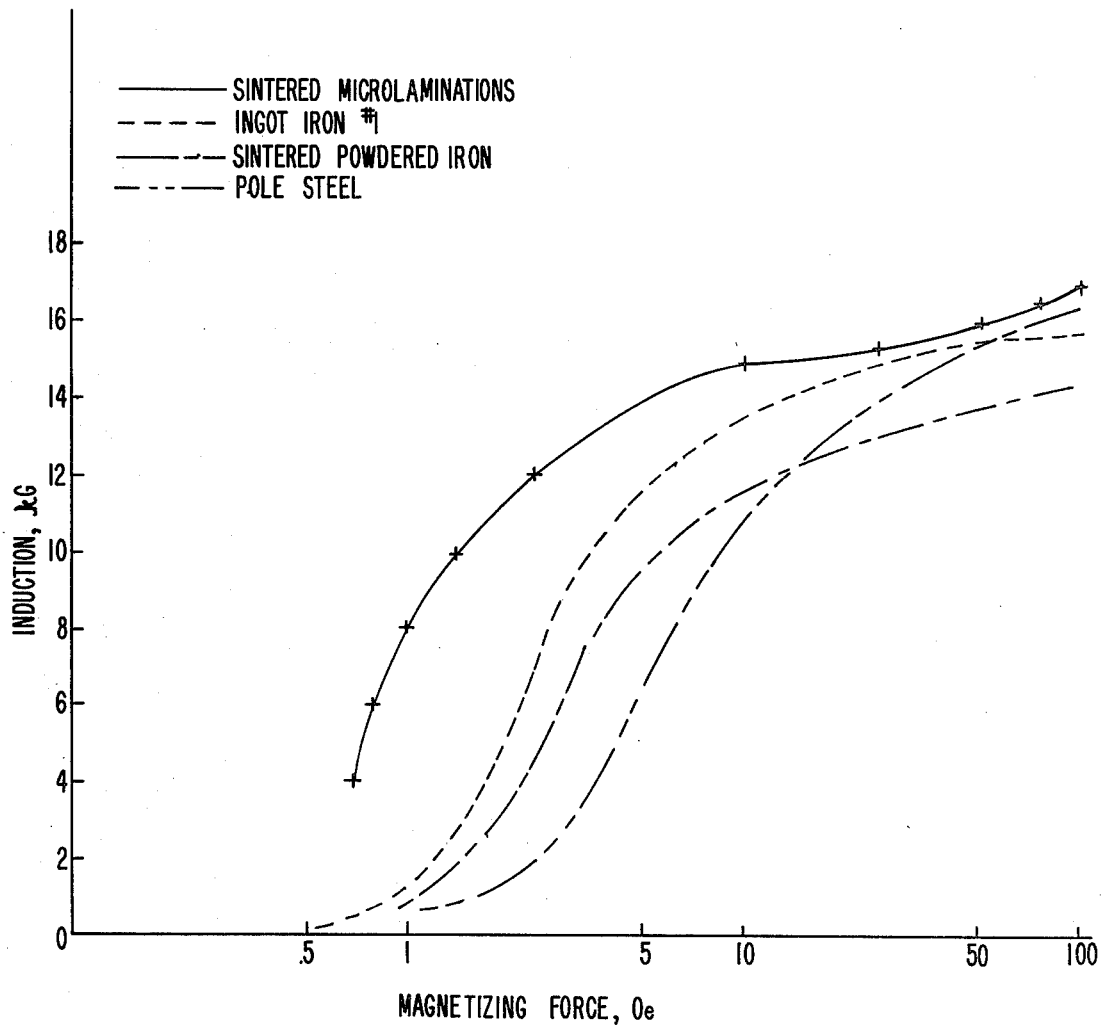
SINTERED MICROLAMINATIONS
INGOT IRON #1
SINTERED POWDERED IRON
POLE STEEL
INDUCTION, kG
0
2
4
6
8
10
12
14
16
18
.5
1
5
10
50
100
MAGNETIZING FORCE, Oe

METHOD OF MAKING MAGNETIC COMPONENT FOR DIRECT CURRENT APPARATUS

CROSS REFERENCE TO RELATED APPLICATIONS

This invention is related to the copending applications of R. F. Krause, N. Pavlik, and K. A. Grunert, Ser. No. 896,525, filed Apr. 14, 1978; R. F. Krause, Ser. No. 896,526, filed Apr. 14, 1978; N. Pavlik and J. Sefko, Ser. No. 896,533, filed Apr. 14, 1978; N. Pavlik, W. T. Reynolds, Ser. No. 896,535, filed Apr. 14, 1978, and R. F. Krause, N. Pavlik, C. Eaves, Ser. No. 896,536, filed Apr. 14, 1978.

BACKGROUND OF THE INVENTION

1. Field of the Invention

This invention relates to magnetic material for use in direct current magnetic applications, and more particularly, it pertains to uncoated microlaminations of annealed low carbon steel.

2. Description of the Prior Art

Pressed and sintered iron powders are currently used in many direct current applications, such as pole faces for DC motors, and for use in a myriad of applications as shown in U.S. Pat. No. 3,235,675. Compacts of this type often replace punched and assembled hot rolled laminated steel (pole steel), ingot iron, or electromagnetic iron. The advantage of the sintered powdered iron over the punched lamination steel and the machined ingot or electromagnetic iron is that the process is scrapless, whereas all alternate methods generate scrap. The disadvantage of pressed and sintered powdered iron compacts is that the magnetic quality is generally inferior to the other materials used in DC applications.

Microlaminations are small rectangular particles that have been cut from low carbon steel or other soft magnetic alloy sheet. Thereafter, the particles are annealed, coated with an electrically insulating material and compressed into a magnetizable compact. Such compacts exhibit magnetic properties, specifically an acceptable core loss, that permits their use in a variety of alternating current magnetic applications. Prior art patents disclosing microlaminations used as magnetizable compacts include U.S. Pat. Nos. 3,848,331 and 3,948,690.

Although a loss level is a requirement for a material used in alternating current apparatus, the low core loss level is not a major need for material used in direct current devices. The most important direct current requirement is a high permeability, low coercive force, and high saturation induction level. The permeability and coercive force of the microlamination compacts when processed as previously described, are considerably poorer than the sintered powdered iron, the ingot iron, the pole steel, and the electromagnetic iron.

SUMMARY OF THE INVENTION

It has been found in accordance with this invention that certain limitations in some prior art devices and processes may be overcome by an improved method for making compact cores for use in direct current magnetic apparatus, comprising the steps of (a) severing microlaminations from thin, flat strips of ferrous alloys, said microlaminations being substantially of elongated rectangular shape, (b) annealing said microlaminations in decarburizing and deoxidizing atmosphere to improve the magnetic characteristics by reducing carbon to less than 0.01% and relieving stresses, (c) compressing the microlaminations into a solidified configuration of the desired core component, and (d) annealing the core component at a temperature over about 1475° F., in a non-oxidizing atmosphere to obtain high permeability and low coercive force values.

The advantage of the method of making a material for direct current applications is that the resulting compacts have magnetic characteristics that are unexpectedly good and superior to sintered powdered iron compacts, annealed ingot iron, low carbon pole steel, and electromagnetic iron, which are the more common materials currently used in DC devices. Moreover, the direct current characteristics of the material are better than annealed low carbon sheet steel. Finally, the method has the advantage of producing no scrap.

BRIEF DESCRIPTION OF THE DRAWING

The only FIGURE of the drawing is a graph illustrating the effect of magnetizing force on induction.

DESCRIPTION OF THE PREFERRED EMBODIMENT

Generally, the method of making compacts for use in direct current magnetic apparatus comprises the steps of:

(a) severing microlaminations from thin, flat strips of ferrous alloys, (b) annealing the microlaminations in decarburizing and deoxidizing atmosphere to improve the magnetic characteristics by reducing carbon content to less than 0.01%, (c) compressing the microlaminations into a solidified configuration, and (d) annealing the solidified compact at a temperature over about 1475° F. in a non-oxidizing atmosphere to obtain low permeability and high coercive force values.

The material from which the microlaminations are made is preferably a plain carbon steel normally of that type used for tin cans. This is a low carbon steel and is recommended because of its low cost and availability The material is usually purchased in the form of "black plate," that is, the condition of the tin can steel prior to tinning. It is readily available in a wide range of thicknesses usually ranging from about 0.005 to about 0.020 inch in thickness. This black plate tin can stock material is one of the lowest cost ferrous products in this thickness range. Typically the AISI Type 1010 steel has a composition containing between about 0.07% and about 0.13% carbon, about 0.30% and about 0.60% manganese, about 0.040% maximum phosphorus, about 0.050% maximum sulfur, and the balance essentially iron with incidental impurities. It is pointed out, however, that while the preferred material is a plain carbon steel, such other magnetic materials as silicon containing steels as well as nickel-iron, molybdenum permalloy, and other intrinsically soft magnetic alloys may be employed in practicing the present invention.

It is preferred to have the steel with some degree of strength to it so that when the microlaminations are formed they do not become grossly distored as will appear more fully hereinafter. Consequently, a plain carbon steel from about 0.05 to 0.15% carbon is ideally suited, for this material will have sufficient strength and yet is sufficiently ductile that the steel can be readily sheared into microlamination sizes as will be described. While exceedingly low carbon steels (more properly called "iron") can be employed, they are not recommended because of the tendency to distort during the microlamination formation operation. The plain carbon steel or other magnetic alloy is usually purchased in the cold rolled condition, the plain carbon steel preferably has a grain size of the order of ASTM No. 9. By employing the various magnetic materials in their cold worked condition, from which the microlamination can be severed, the resulting microlamination is in the form of a thin, elongated parallelopiped of substantially rectangular cross-section. The cold worked condition of the flat worked sheet material thus facilitates the formation and the retention of the as severed shape. Moreover, the cold worked condition with its consequent higher strength and lowered ductility fosters a cleaner edge (less burring), during the severing operation so that when the microlaminations are molded into the finished configuration, the tendency to pierce the insulation is considerably reduced.

At the outset, it should be noted that while a wide range of steel particles sizes and thicknesses are satisfactory, it is nonetheless preferred to control the microlaminations to the form of a thin elongated parallelopiped of rectangular cross-section having dimensions between about 0.05 and about 0.20 inch in length, about 0.005 and about 0.05 inch in width and from about 0.002 to about 0.02 inch in thickness. Within this broad range, particularly satisfactory results have been obtained where the individual microlamination particle length ranges from about 0.050 to about 0.150 inch, from about 0.010 to about 0.030 inch in width and between about 0.006 to about 0.013 inch in thickness. The microlaminations are usually formed from the tin can stock to the foregoing dimensions by cutting with a high speed rotary die cutter as set forth in U.S. Pat. No. 3,848,331.

The second step of annealing the microlaminations has the primary purpose of decarburizing the microlamination particles. Decarburization occurs within a temperature range of from about 1325° F. to about 1650° F. The time involved varies from about 10 minutes to 2 hours and is dependent upon the size of the particles and the temperature. Normally, a deoxidizing atmosphere is sufficient. However, specialized atmospheres, such as wet hydrogen having a dew point in excess of about +60° F., may be utilized. Thereafter, a dry atmosphere having a dew point of less than about −40° C. to provide a protective atmosphere during cooling of the microlaminations to room temperature.

The third step involves pressing or compaction of the microlamination particles after they have been assembled into the desired configuration, such as a core for a DC motor. Compression may occur either unaxially or isostatically, as disclosed in U.S. Pat. Nos. 3,948,690 and 3,848,331, respectively. Workable pressures of from 50,000 to 120,000 psi have been used with the preferred pressure being 120,000 psi. The higher the pressure (for density), the better the magnetic characteristics of the resulting compact.

The fourth step of the method involves an anneal subsequent to the compression step. The annealing temperature may vary from about 1400° F. to 2200° F. and preferably at 2200° F. It has been found that the higher the annealing temperature, the better the resulting magnetic properties for the compact.

By following the foregoing method, the magnetic quality, specifically the coercive force and the permeability are substantially and unexpectedly improved by altering the traditional processing of the microlamination particles. In particular, the particles are not coated with an insulative coating prior to the pressing operation and after pressing, the compacted particles are annealed at a temperature over 1475° F. in a non-oxidizing atmosphere. The maximum permeability ($\mu_{max}$) is observed to improve by better than a factor of 10 over the permeability of microlaminations processed by the traditional method and the coercive force is reduced by a better than a factor of 6. For example, the maximum permeability of the insulated and pressed microlamination compact is of the order of 700 and the coercive force 4.0 $O_e$, whereas the maximum permeabilty of the compact processed as described is greater than 7500 and the coercive force is 0.67 $O_e$.

More significantly, however, is the comparison of the magnetic properties of the compact and the magnetic quality of those materials currently used in direct current devices, such as pole steel, sintered powdered iron, ingot iron, and electromagnetic iron. In the Table, the annealed microlamination compact is superior in every DC magnetic property to all of the other possible alternative materials. Moreover, the quality of the compact of the sintered microlaminations is comparable to that of the low carbon steel. The data of the Table is illustrated in the drawing where it is evident that for each value of magnetizing force, H, in oersteds, Oe, the induction B in kilogauss is higher. Thus, it is evident that compacts comprised of annealed microlaminations are superior to the other materials listed in the Table.

TABLE

D.C. MAGNETICS OF VARIOUS SOFT MAGNETIC MATERIALS

| | B at 1 Oe (kG) | B at 10 Oe (kG) | $B_r$ (kG) | $H_c$ (Ce) | $\mu_{max}$ |
|---|---|---|---|---|---|
| Sintered Microlaminations | 8.5 | 14.9 | 11.0 | 0.67 | ≈8000 |
| Sintered Powdered Iron+ | 0.8 | 11.8 | N.A. | N.A. | 2362 |
| Ingot Iron #1+ | 1.4 | 13.6 | N.A. | N.A. | 2884 |
| Ingot Iron #2++ | 4.8 | N.A. | 6.5 | 0.76 | 5550 |
| Electromagnet Iron++ | 3.7 | N.A. | 5.2 | 0.82 | 5600 |
| Pole Steel* | 0.8 | 11.8 | N.A. | N.A. | 1400 |
| Low Carbon Steel** | ≈8.0 | ≈14.8 | ≈13.3 | ≈0.67 | N.A. |

+Technical Data Sheet No. 1005, A.O. Smith-Inland Inc., Powder Metallurgy Division (1969).
++Electromagnet Iron - A New Magnetically Stable Core Iron, Armco Steel Corp., p. 9.
*USS Non-Oriented Electrical Steel Sheets, United States Steel Corp., p. 209. Compensated for a 94% space factor.
**Compensated for a 96% space factor.
N.A. —Not Available.

In conclusion, a magnetic compact comprised of uncoated microlaminations and annealed in a non-oxidizing atmosphere exhibits unexpectedly good magnetic quality for use in direct current applications. The magnetic characteristics are superior to those of sintered powder iron compacts, annealed ingot iron, low carbon pole steel, and electromagnetic iron which are the more common materials currently used in direct current device. Finally, the direct current characteristics of the material described are better than annealed low carbon sheet steel.

What is claimed is:

1. A method of making cores for use in direct current magnetic apparatus, comprising the steps of:

(a) forming microlaminations from thin, flat strips of ferromagnetic alloys, said microlaminations being substantially of elongated rectangular shape having a length of between about 0.05 to about 0.02 inch, (b) annealing said microlaminations in decarburizing and deoxidizing atmosphere at a temperature range of from about 1325° F. to about 1650° F. for a time period of up to about 2 hours in wet hydrogen having a dew point in excess of about +60° F. to improve the magnetic characteristics and to reduce the carbon to less than 0.01%, (c) pressing the microlaminations into a predetermined configuration of the desired core, and (d) annealing the core at a temperature of from about 1400° F. to about 2200° F. in a non-oxidizing atmosphere to obtain high permeability and low coercive force values, thereby providing a magnetic compact having uncoated, non-oxidized microlaminations and having superior magnetic quality for direct current apparatus.

2. The method of claim 1 in which the material from which the microlaminations are formed is an iron alloy having a carbon content between about 0.05% and about 0.15%.

3. The method of claim 1 in which the microlaminations have a width of from about 0.005 to about 0.05 inch and a thickness of from about 0.002 to about 0.02 inch.

4. The method of claim 1 in which the microlaminations are compressed to a pressure of greater than 50,000 psi.

5. The method of claim 1 in which the temperature is about 2200° F.

* * * * *